US008559857B2

(12) United States Patent
Takiguchi

(10) Patent No.: US 8,559,857 B2
(45) Date of Patent: Oct. 15, 2013

(54) TRANSFER DEVICE AND IMAGE FORMING APPARATUS

(75) Inventor: Toshiki Takiguchi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 357 days.

(21) Appl. No.: 13/159,774

(22) Filed: Jun. 14, 2011

(65) Prior Publication Data

US 2011/0305489 A1 Dec. 15, 2011

(30) Foreign Application Priority Data

Jun. 14, 2010 (JP) ..... 2010-134912

(51) Int. Cl.
*G03G 15/20* (2006.01)

(52) U.S. Cl.
USPC ..... 399/312

(58) Field of Classification Search
USPC ..... 399/312, 303, 308, 121, 302
See application file for complete search history.

(56) References Cited

U.S. PATENT DOCUMENTS 7,050,737 B2 5/2006 Kobayashi
7,113,725 B2 * 9/2006 Ogashiwa et al. ..... 399/121
2007/0019998 A1 * 1/2007 Inui et al. ..... 399/302
2008/0205946 A1 * 8/2008 Kim et al. ..... 399/303
2009/0208241 A1 8/2009 Takiguchi et al.

FOREIGN PATENT DOCUMENTS

JP 2000-112259 4/2000
JP 2004-085702 3/2004
JP 2004-138813 5/2004
JP 2006-323272 11/2006
JP 2009-198723 9/2009
JP 2010-066302 3/2010

* cited by examiner

*Primary Examiner* — Walter L Lindsay, Jr.
*Assistant Examiner* — Rodney Bonnette
(74) *Attorney, Agent, or Firm* — Nixon & Vanderhye, P.C.

(57) ABSTRACT

A transfer device includes a transfer belt, a plurality of rollers, and meandering preventive ribs. The plurality of rollers entrain the transfer belt thereabout. The meandering preventive ribs are provided at opposite widthwise ends of an inner peripheral surface of the transfer belt for preventing the transfer belt from meandering on the plurality of rollers. The plurality of rollers include at least one hollow roller having a central shaft and a plurality of internal ribs connecting the central shaft with an inner periphery of the hollow roller in a radial manner. The internal ribs are located so as not to come into contact with the meandering preventive ribs.

9 Claims, 8 Drawing Sheets

TRANSFER DEVICE AND IMAGE FORMING APPARATUS

CROSS REFERENCE

This Nonprovisional application claims priority under 31 U.S.C. §119(a) on Patent Application No. 2010-134912 filed in Japan on Jun. 14, 2010, the entire contents of which are hereby incorporated by reference.

BACKGROUND OF THE INVENTION

The present invention relates to a transfer device employing a hollow roller as a roller for entraining a transfer belt, as well as an image forming apparatus incorporating such a transfer device.

An electrophotographic image forming apparatus uses a transfer device for transferring a developer image born on a surface of a photoreceptor to a recording sheet. Since the transfer device is in contact with the photoreceptor during printing, the transfer device has to be moved so as to separate from the photoreceptor when a sheet jam occurs. In order to reduce the weight of the whole transfer device, consideration is given to use of a hollow roller as a roller entraining the transfer belt.

However, the use of such a hollow roller for entraining the raises a problem that a required strength for entraining the transfer belt cannot be obtained.

In attempt to solve this problem, a transfer device has been disclosed which includes a hollow roller formed with a plurality of ribs extending from a bearing of the hollow roller toward the inner periphery of the roller (see Japanese Patent Laid-Open Publication No. 2004-138813 for example).

The transfer belt used in the transfer device is a member comprising elastic rubber and formed with meandering preventive ribs which are provided at opposite edges of the belt on the side in contact with the roller and which project in a direction perpendicular to the longitudinal direction of the roller. The ribs of the hollow roller disclosed in Japanese Patent Laid-Open Publication No. 2004-138813 have longitudinal end faces located coplanar with an end face of the hollow roller.

Therefore, in cases where the hollow roller disclosed in Japanese Patent Laid-Open Publication No. 2004-138813 is used as a roller for entraining the transfer belt of the transfer device, the meandering preventive ribs of the transfer belt come into contact with the rib edges of the hollow roller, thereby raising problems that: the meandering preventive ribs are shaved; and meandering preventive ribs run on the hollow roller. This is because the edges of concern come into contact with the meandering preventive ribs so as to resist the moving track of the meandering preventive ribs.

When rubber debris resulting from shaving of the meandering preventive ribs is scattered inwardly of the transfer belt, an uneven transfer nip occurs, which causes a poor image quality to result. When the rubber debris is scattered in a cleaning blade nip associated with the photoreceptor, a cleaning failure is caused to occur. When the meandering preventive ribs of the transfer belt run on the hollow roller, problems arise that: the transfer belt broken; and the transfer device body becomes faulty.

In view of the foregoing problems, a feature of the present invention is to provide a transfer device capable of preventing the ribs of the hollow roller from shaving the meandering preventive ribs which are formed on the transfer belt for preventing the transfer belt from meandering while preventing the meandering preventive ribs from running on the hollow roller.

SUMMARY OF THE INVENTION

A transfer device according to the present invention includes a transfer belt, a plurality of rollers, and meandering preventive ribs. The plurality of rollers entrain the transfer belt thereabout. The meandering preventive ribs are provided at opposite widthwise ends of an inner peripheral surface of the transfer belt for preventing the transfer belt from meandering on the plurality of rollers. The plurality of rollers include at last one hollow roller having a central shaft and a plurality of internal ribs connecting the central shaft with an inner periphery of the hollow roller in a radial manner. The internal ribs are located so as not to come into contact with the meandering preventive ribs.

With this arrangement, the internal ribs of the hollow roller fail to come into contact with the meandering preventive ribs of the transfer belt. Therefore, the meandering preventive ribs are prevented from being shaved by the edges of the internal ribs of the hollow roller and, hence, rubber debris will not be produced from the meandering preventive ribs. Thus, it is not possible that such rubber debris scattered inwardly of the transfer belt causes an uneven transfer nip to occur and hence causes a poor image quality to result. It is not possible either that the rubber debris scattered in a cleaning blade nip associated with a photoreceptor causes a cleaning failure to occur. Therefore, a good image quality can be maintained.

Since the arrangement according to the present invention prevents the internal ribs of the hollow roller and the meandering preventive ribs of the transfer belt from coming into contact with each other as described above, the edges of the internal ribs of the hollow roller fail to cause the meandering preventive ribs of the transfer belt to run on the hollow roller. Therefore, it is unlikely that the transfer belt is broken. It is also unlikely that the transfer device body becomes faulty.

DETAILED DESCRIPTION OF THE INVENTION

Hereinafter, transfer devices according to embodiments of the present invention will be described in detail with reference to the drawings.

Description will be made of a first embodiment.

Figure 1:
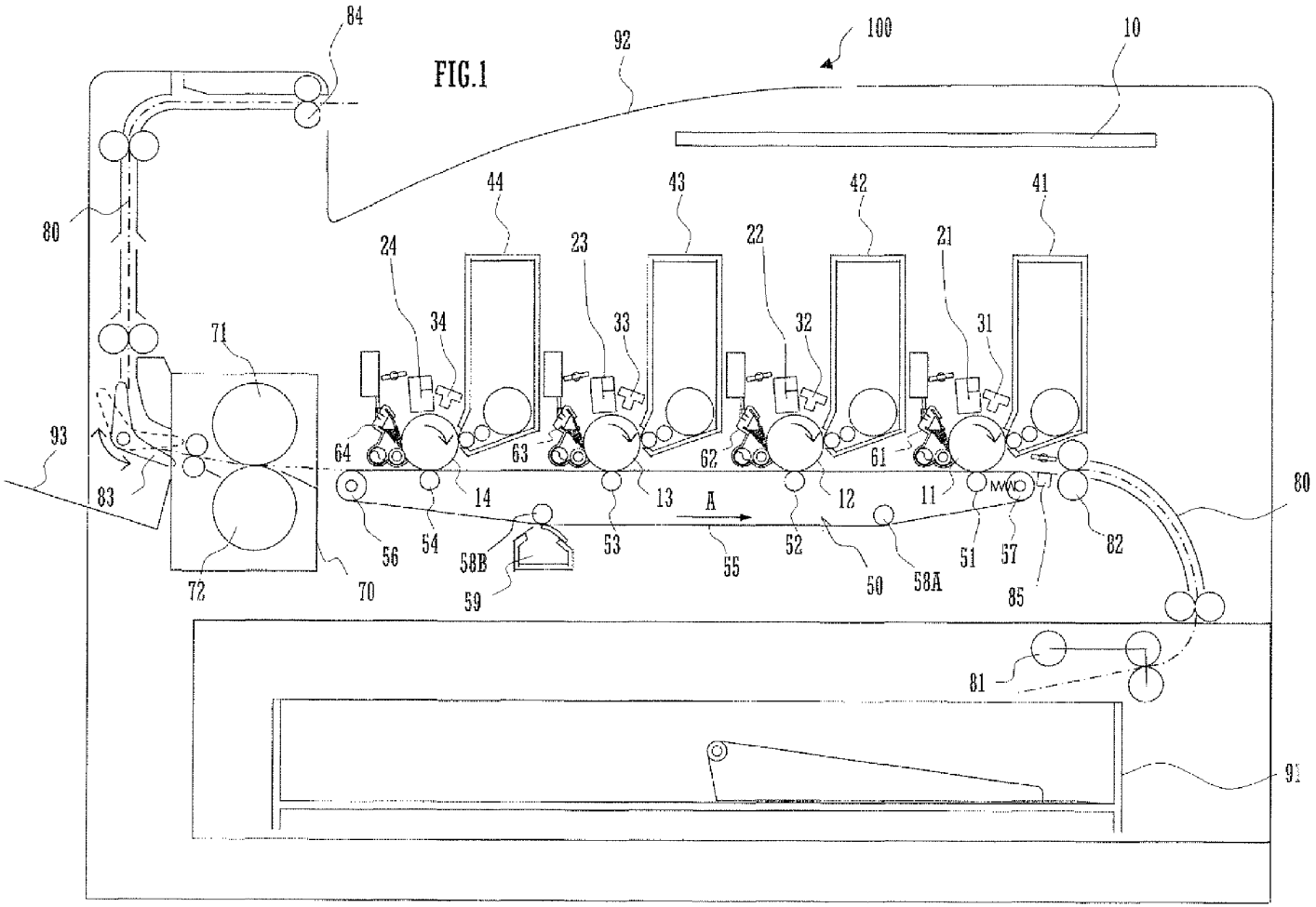
FIG. 1 is a view illustrating the structure of an image forming apparatus incorporating a transfer device according to a first embodiment of the present invention.

FIG. 1 is a view illustrating the structure of an image forming apparatus 100 incorporating a transfer device 50 according to the first embodiment of the present invention.

The image forming apparatus 100 includes photoreceptor drums 11 to 14, electrostatic charger devices 21 to 24, exposure devices 31 to 34, developing devices 41 to 44, transfer device 50, cleaning devices 61 to 64, fixing device 70, sheet feed path 80, sheet feed tray 91, and sheet catch trays 92 and 93.

Image data items processed by the image forming apparatus 100 correspond to color images to be formed using the respective colors: black (K), cyan (C), magenta (M) and yellow (Y). Therefore, there are provided four photoreceptor drums 11 to 14, four electrostatic charger devices 21 to 24, four exposure devices 31 to 34, four developing devices 41 to 44 and four cleaning devices 61 to 64 to form four image forming stations configured to form four types of image corresponding to the respective colors (K), (C), (M) and (Y).

The photoreceptor drums 11 to 14 are located substantially centrally of the image forming apparatus 100.

Each of the electrostatic charger devices 21 to 24 is means for electrostatically charging a peripheral surface of a respective one of the photoreceptor drums 11 to 14 to a predetermined potential uniformly. Besides a contact-type electrostatic charger device using a roller or a brush, the electrostatic charger devices 21 to 24 of the charger type as shown in FIG. 1 may be used.

The exposure devices 31 to 34 each use a laser scanning unit (LSU) which comprises a writing head having an array of light-emitting devices such as ELs or LEDs for example, a laser emitting section, and a reflecting mirror. The exposure devices 31 to 34 have the function of exposing the photoreceptor drums 11 to 14 in an electrostatically charged state to light according to image data inputted thereto, thereby forming electrostatic latent images on the peripheral surfaces of the respective photoreceptor drum 11 to 14 according to the image data.

The developing devices 41 to 44 are configured to visualize the electrostatic latent images formed on the respective photoreceptor drums 11 to 14 by the use of toners (K), (C), (M) and (Y).

The cleaning devices 61 to 64 are configured to remove and recover residual toners remaining on the respective photoreceptor drums 11 to 14.

The transfer device 50 disposed below the photoreceptor drums 11 to 14 includes transfer rollers 51 to 54, a transfer belt 55, a transfer belt driving roller 56, a transfer belt tension roller 57, transfer belt driven rollers 58A and 58B, and a transfer belt cleaning unit 59.

The transfer belt driving roller 56, transfer belt tension roller 57, transfer rollers 51 to 54 and transfer belt driven rollers 58A and 58B entrain the transfer belt 55 thereabout to drive the transfer belt 55 for rotation in the direction indicated by arrow A.

Each of the transfer rollers 51 to 54 performs application of a transfer bias for transferring a toner image from a respective one of the photoreceptor drums 11 to 14 onto a sheet being fed as attracted on the transfer belt 55.

The transfer belt 55 is positioned so as to contact the photoreceptor drums 11 to 14. The transfer belt 55 has the function of forming a color toner image by sequentially transferring the toner images from the photoreceptor drums 11 to 14 onto the sheet so as to superimpose them on one another. The transfer belt 55 is formed into an endless belt by using a film having a thickness of about 100 μm to about 150 μm.

The transfer of the toner images from the photoreceptor drum 11 to 14 to the sheet is achieved by the transfer rollers 51 to 54 in contact with the reverse side of the transfer belt 55. Each of the transfer rollers 51 to 54 is applied with a high transfer bias voltage (i.e., a high voltage having a polarity (+) opposite to the polarity (−) of the toner charged) in order to transfer the toner image.

Each of the transfer rollers 51 to 54 is a roller comprising a shaft of metal (e.g., stainless steel) having a diameter of 8 to 10 mm as a base, and an electrically conductive elastic material (e.g., EPDM or urethane foam) covering the surface of the shaft. The electrically conductive elastic material enables the sheet to be uniformly applied with the high voltage. While the present embodiment uses the transfer electrode in the form of a roller, it is possible to use a transfer electrode in the form of a brush or the like instead of such a roller.

Toner thus attached to the transfer belt 55 by contact between the photoreceptor drums 11 to 14 and the transfer belt 55 is removed and recovered by the transfer belt cleaning unit 59 because such toner causes the reverse side of the sheet to be stained. The transfer belt cleaning unit 59 includes, for example, a cleaning blade as a cleaning member for contact with the transfer belt 55. The transfer belt 55 contacted by the cleaning blade is supported by the transfer belt driven roller 58B from the reverse side thereof.

The sheet feed tray 91, which is a tray for storing sheets to be used for image formation, is disposed below the image forming section of the image forming apparatus 100. The sheet catch tray 92 which is disposed in an upper portion of the image forming apparatus 100 is a tray for receiving a sheet finished with image formation in a facedown fashion. The sheet catch tray 93 which is disposed at a lateral side of the image forming apparatus 100 is a tray for receiving a sheet finished with image formation in a faceup fashion.

The image forming apparatus 100 defines therein the S-shaped sheet feed path 80 for feeding a sheet from the sheet feed tray 91 to the sheet catch tray 92 via the transfer device 50 and the fixing device 70. Adjacent the sheet feed path 80 extending from the sheet feed tray 91 to the sheet catch trays 92 and 93, there are disposed a pickup roller 81, registration rollers 82, fixing device 70, feeding direction switching guide 83, and feed rollers 84.

The feed rollers 84 are small-size rollers for facilitating and helping the sheet feeding. Plural pairs of such feed rollers 84 are disposed along the sheet feed path 80.

The pickup roller 81, which is located adjacent an end portion of the sheet feed tray 91, is an introduction roller for feeding sheets one by one from the sheet feed tray 91 into the sheet feed path 80.

The registration rollers 82 serve to temporarily hold a sheet being fed on the sheet feed path 80. The registration rollers 82 have the function of feeding the sheet in a manner timed to the rotation of the photoreceptor drums 11 to 14 in order for the toner images on the respective photoreceptor drums 11 to 14 to be transferred onto the sheet as superimposed on one another properly. The registration rollers 82 are set to feed the sheet in response to a detection signal from a line sensor 85 so that the leading edges of the toner images on the respective photoreceptor drums 11 to 14 meet the leading edge of an image forming region of the sheet.

The fixing device 70 includes a heating roller 71 and a pressurizing roller 72 which are configured to rotate while nipping a sheet therebetween. The heating roller 71 is controlled by a control section 10 based on signals from a non-illustrated temperature detector so that a predetermined fixing temperature is reached. The heating roller 71 has the function of fusing, mixing and pressure-contacting a polychrome toner image transferred to the sheet by heat-bonding the toner to the sheet cooperatively with the pressurizing roller 72, thereby fixing the toner image onto the sheet by heat.

The sheet to which the polychrome toner image has been fixed is outputted to the sheet catch tray 92 by the feed rollers 84.

The feeding direction switching guide 83 can pivot from the position depicted by solid line to the position depicted by broken line to separate a sheet from the sheet feed path 80 at an intermediate point, thereby outputting the sheet to the sheet catch tray 93. When the feeding direction switching guide 83 is in the position depicted by solid line, a sheet is passed on the sheet feed path 80 and then outputted to the upper sheet catch tray 92.

While the present embodiment has an exemplary arrangement for transferring toner images from the photoreceptor drums 11 to 14 onto a sheet being fed by the transfer belt 55, there is no limitation to this arrangement. Another arrangement is possible in which toner images are transferred from the photoreceptor drums 11 to 14 to an image bearing member (e.g., intermediate transfer member) which is different in type from the photoreceptor drums 11 to 14 and then transferred from the intermediate transfer member to a sheet being fed by the transfer belt 55.

Figure 2:
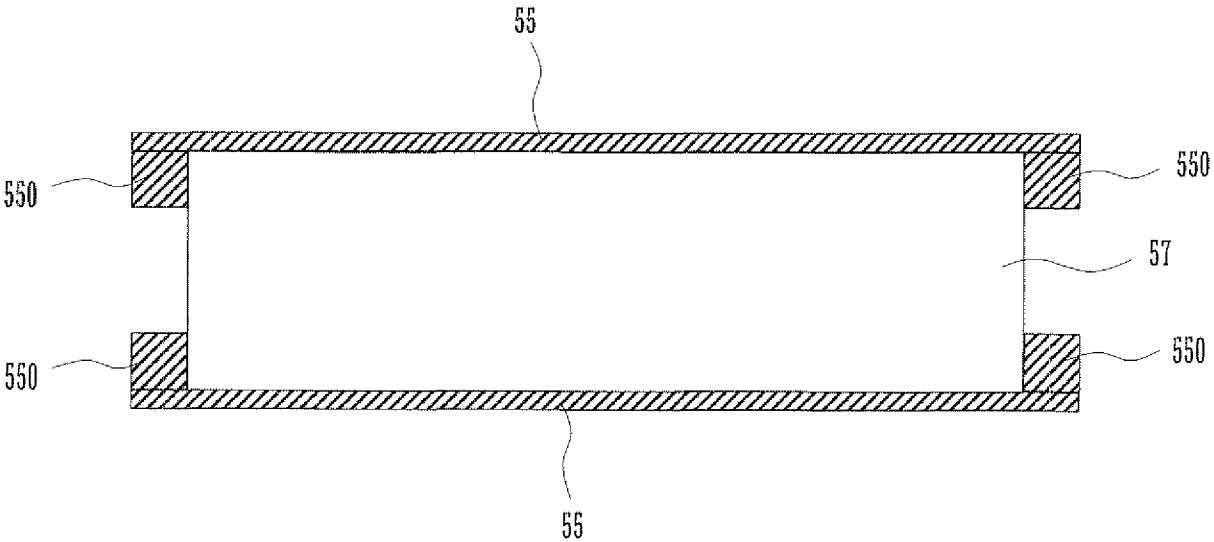
FIG. 2 is a sectional side elevational view illustrating a transfer belt tension roller used in the transfer device according to the first embodiment of the present invention.

FIG. 2 is a sectional side elevational view illustrating the transfer belt tension roller 57 used in the transfer device 50 according to the first embodiment of the present invention.

The transfer device 50 includes transfer belt 55, transfer belt driving roller 56, transfer belt tension roller 57, transfer rollers 51 to 54, transfer belt driven rollers 58A and 58B, and meandering preventive ribs 550. The transfer belt driving roller 56, transfer belt tension roller 57, transfer rollers 51 to 54 and transfer belt driven rollers 58A and 58B are equivalent to the "plurality of rollers" defined by the present invention.

The transfer belt driving roller 56, transfer belt tension roller 57, transfer rollers 51 to 54 and transfer belt driven rollers 58A and 58B entrain the transfer belt 55 thereabout. The meandering preventive ribs 550 are provided at opposite widthwise ends of the inner peripheral surface of the transfer belt 55 for preventing the transfer belt 55 from meandering on the transfer belt driving roller 56, transfer belt tension roller 57, transfer rollers 51 to 54 and transfer belt driven rollers 58A and 58B.

At least one of the transfer belt driving roller 56, transfer belt tension roller 57, transfer rollers 51 to 54 and transfer belt driven rollers 58A and 58B is a hollow roller having a plurality of internal ribs bridging between the central shaft and the inner periphery of the hollow roller. The internal ribs are located so as not to come into contact with the meandering preventive ribs 550.

In the present embodiment and the embodiments subsequent thereto, description will be made of the structure of the transfer belt tension roller 57 as an example of such a hollow roller. As described above, the transfer belt tension roller 57 is one of the rollers entraining the transfer belt 55 thereabout.

The transfer belt 55 is melded of an NBR rubber. The meandering preventive ribs 550 are also molded of an NBR rubber and formed integrally with the transfer belt 55. The meandering preventive ribs 550 have the function of preventing the transfer belt 55 from meandering on the entraining rollers including the transfer belt tension roller 57 and the like.

The meandering preventive ribs 550 preferably project to a distance of about 1.5 mm to about 2.0 mm from the inner peripheral surface of the transfer belt 55. If the projecting distance is less than 1.5 mm, the meandering preventive ribs 550 can not sufficiently prevent the transfer belt 55 from meandering on the entraining rollers and, hence, may run on the entraining rollers. If the projecting distance is more than 2.0 mm, the bending strain of the meandering preventive ribs 550 causes the transfer belt 55 to slip on the rollers and, hence, non-uniform rotation of the transfer belt 55 is likely.

Figure 3:
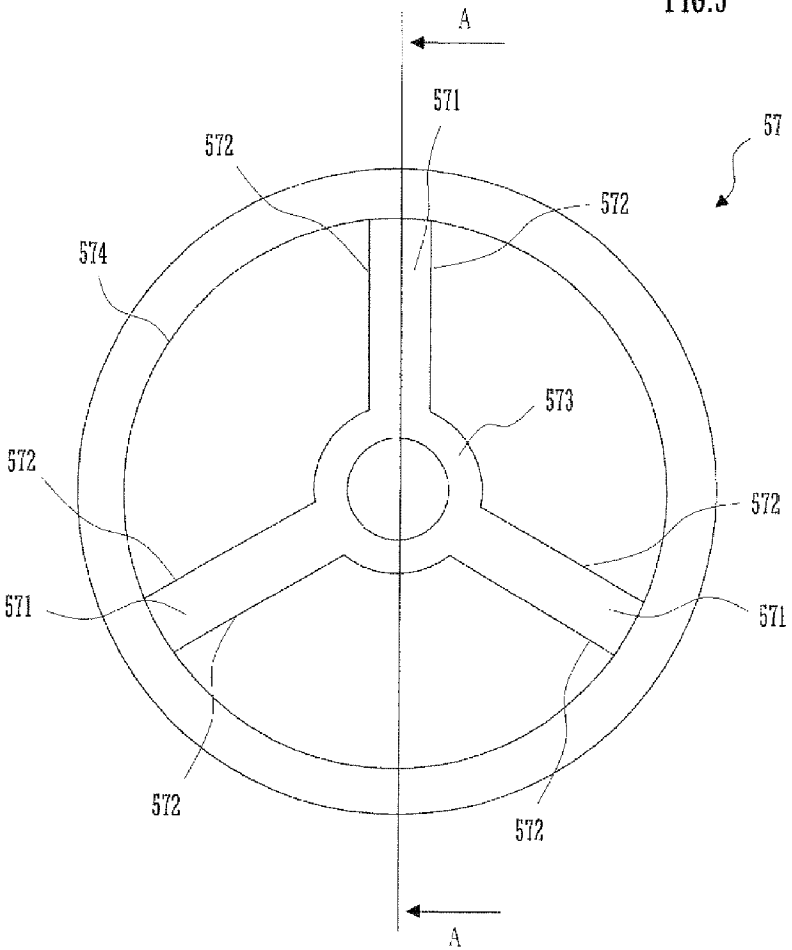
FIG. 3 is a front elevational view illustrating the transfer belt tension roller used in the transfer device to according to the first embodiment of the present invention.

FIG. 3 is a front elevational view illustrating the transfer belt tension roller 57 used in the transfer device 50 according to the first embodiment of the present invention.

The transfer belt tension roller 57 is a hollow roller having a plurality of internal ribs 571 bridging between a bearing 573 forming a central shaft and an inner periphery 574. A non-illustrated shaft member is fitted into the bearing 573. In the present embodiment, the transfer belt tension roller 57 is provided therein with three such internal ribs 571 which extend radially from the hearing 573 at equal intervals. Stated otherwise, the internal ribs 571 are positioned equiangularly about the bearing 573 within the transfer belt tension roller 57. The transfer belt tension roller 57 having such a structure can have a reduced weight and an enhanced strength for entraining the transfer belt 55.

However, burr is likely to be formed on edges 572 of the internal ribs 571 by cutting. For this reason, when the internal ribs 571 are brought into contact with the meandering preventive ribs 550, there arise the problems that: the meandering preventive ribs 550 are shaved; and the meandering preventive ribs 550 run on the transfer belt tension roller 57. This is because rotation of the transfer belt 55 causes the edges 572 to come into contact with the meandering preventive ribs 550 so as to resist against the moving track of the meandering preventive ribs 550. Machining is necessary to remove the burr. Such machining is difficult because the transfer belt tension roller 57 has a small diameter.

In the present embodiment and the embodiments subsequent thereto, description will be made of the transfer belt tension roller 57 having a structure for solving the problems described above.

Figure 4B:
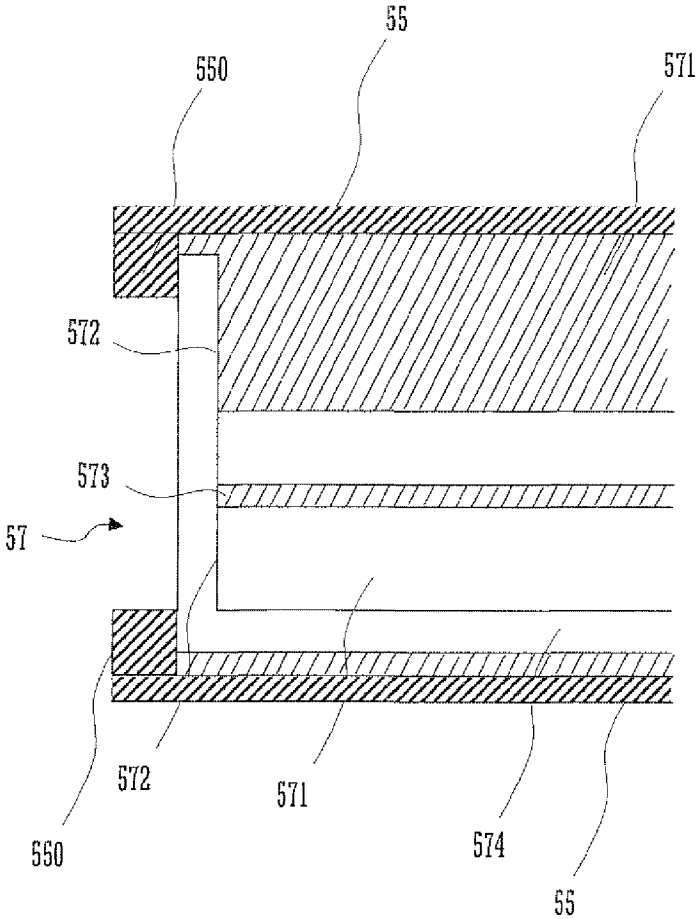
FIG. 4B is a sectional view, taken on line A-A, of the transfer belt tension roller shown in FIG. 3.

FIG. 4 is a sectional view, taken on line A-A, of the transfer belt tension roller 57 used in the transfer device 50 according to the first embodiment of the present invention.

Figure 4A:
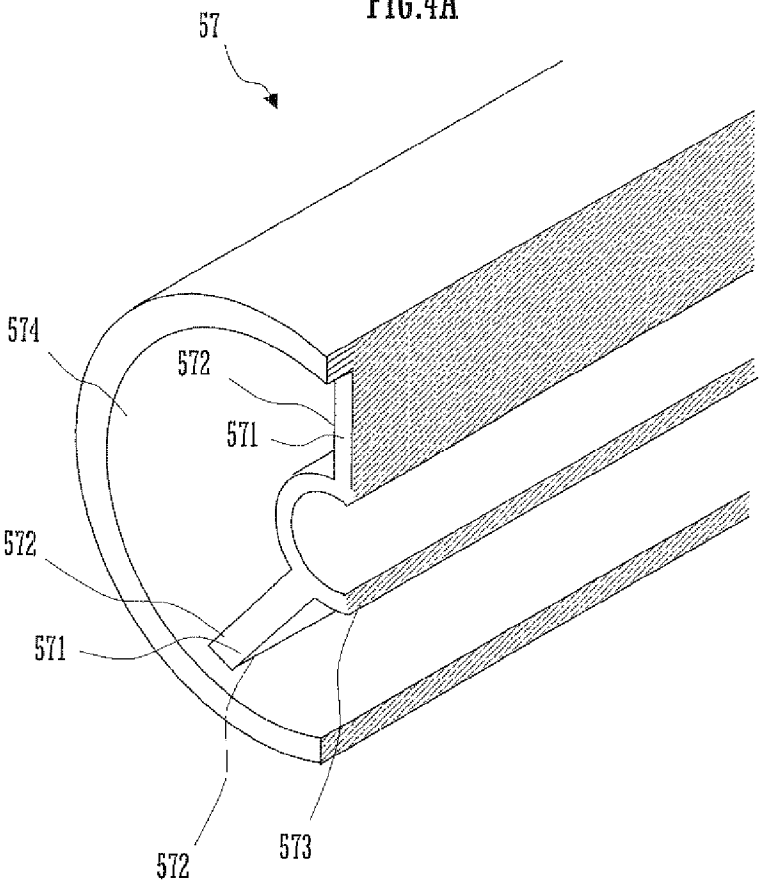
FIG. 4A is a perspective sectional view, taken on line A-A, of the transfer belt tension roller shown in FIG. 3.

Specifically, FIG. 4A perspective sectional view, taken on line A-A, of the transfer belt tension roller 57 shown in FIG. 3; and FIG. 43 is a sectional view, taken on line A-A, of the transfer belt tension roller 57 shown in FIG. 3. In the present embodiment, longitudinal end faces of the internal ribs 571 and a longitudinal end face of the bearing 573 are located inwardly from a longitudinal end face of the transfer belt tension roller 57.

With this structure, the internal ribs 571 and the meandering preventive ribs 550 fail to come into contact with each other. Therefore, the meandering preventive ribs 550 will never be shaved by the edges 572 of the internal ribs 571 and, hence, the meandering preventive ribs 550 will not produce rubber debris. Thus, it is not possible that such rubber debris scattered inwardly of the transfer belt 55 causes an uneven transfer nip to occur and hence causes a poor image quality to result. It is not possible either that the rubber debris scattered in cleaning blade nips associated with the respective photoreceptor drums 11 to 14 causes a cleaning failure to occur. Therefore, a good image quality can be maintained.

Since the internal ribs 571 and the meandering preventive ribs 550 fail to come into contact with each other as described above, the edges 572 of the internal ribs 571 fail to cause the meandering preventive ribs 550 to run on the transfer belt tension roller 57. Therefore, it is not likely that the transfer belt 55, is broken and the transfer device 50 becomes faulty.

Preferably, the end faces of the internal ribs 571 are located inwardly by about 1.0 mm from the end face of the transfer belt tension roller 57. Machining is necessary for the end faces of the internal ribs 571 to be located inwardly from the end face of the transfer belt tension roller 57. Even when the internal ribs 571 are located further inwardly from the end face of concern, a further improvement in the above-described effect cannot be expected, while the machining cost increases. When the end faces of the internal ribs 571 are located inwardly by only about 0.5 mm from the end face of concern, the above-described effect can not sufficiently be obtained.

Description will be made of a second embodiment of the present invention. Throughout the second and third embodiments, redundant description will not be made of the features having been already described in relation to the first embodiment.

Figure 5:
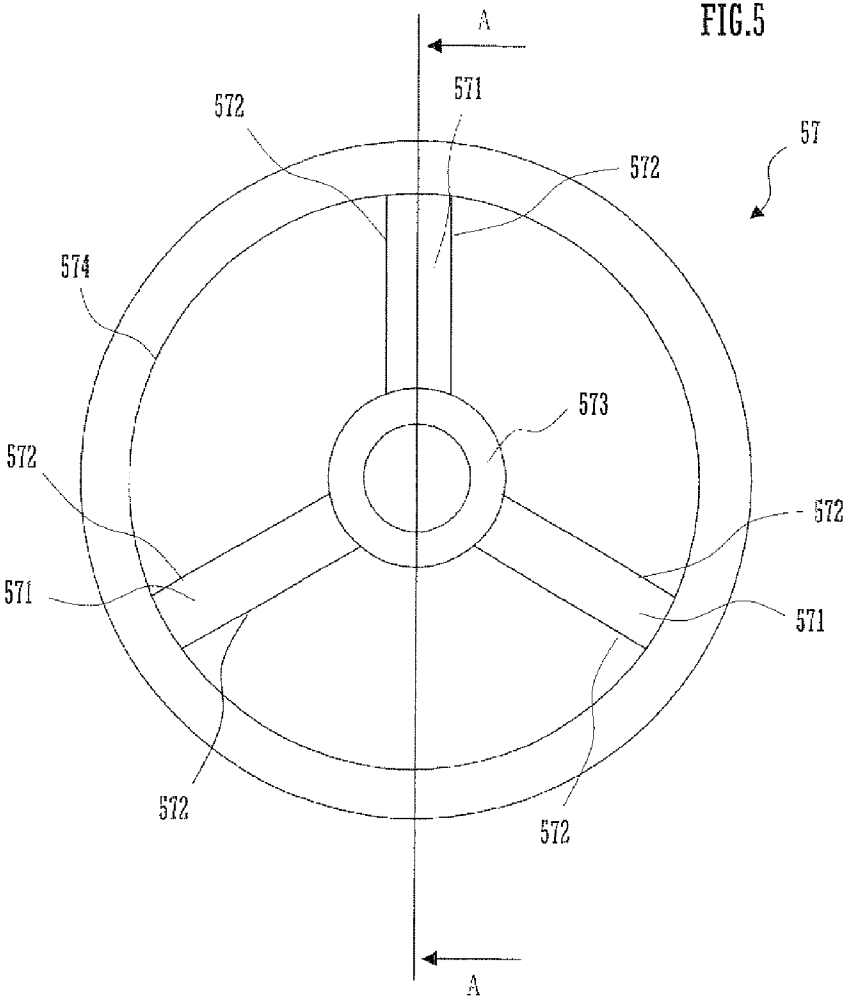
FIG. 5 is a front elevational view illustrating a transfer belt tension roller used in a transfer device according to a second embodiment of the present invention.
Figure 6B:
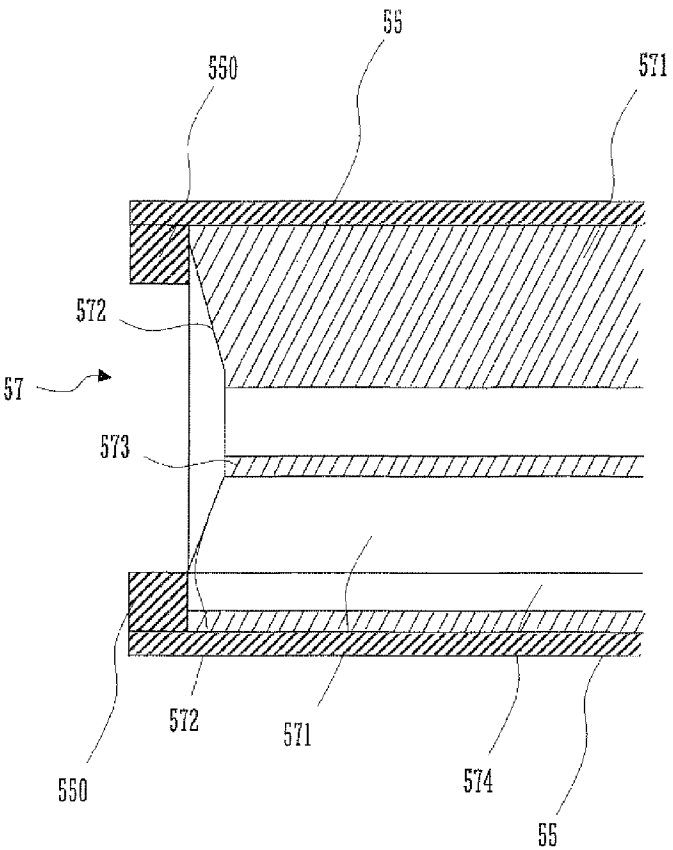
FIG. 6B is a sectional view, taken on line A-A, of the transfer belt tension roller 57 shown in FIG. 5.

FIG. 5 is a front elevational view illustrating a transfer belt tension roller 57 used in a transfer device 50 according the second embodiment of the present invention. FIG. 6 is a sectional view, taken on line A-A, of the transfer belt tension roller 57 used in the transfer device 50 according to the second embodiment of the present invention.

Figure 6A:
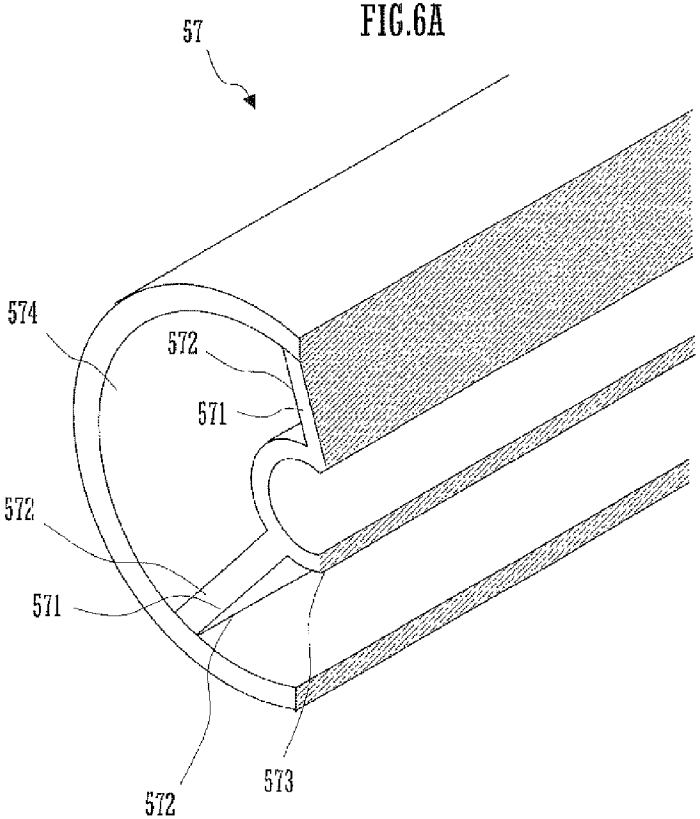
FIG. 6A is a perspective sectional view, taken on line A-A, of the transfer belt tension roller 57 shown in FIG. 5.

Specifically, FIG. 6A is a perspective sectional view, taken on line A-A, of the transfer belt tension roller 57 shown in FIG. 5; and FIG. 68 is a sectional view, taken on line A-A, of the transfer belt 57 shown in FIG. 5. In the present embodiment, the end faces of the internal ribs 571 are inclined in such a manner as to go away from the end face of the transfer belt tension roller 57 as they extend from the inner periphery toward the bearing 573 of the transfer belt tension roller 57.

With this feature, the internal ribs 571 joined to the inner periphery 574 extend up to the longitudinal end face of the transfer belt tension roller 57. For this reason, the transfer belt tension roller 57 according to the present embodiment has a higher strength for entraining the transfer belt 55 than that according to the first embodiment. Therefore, the transfer belt tension roller 57 has a higher strength against the elasticity of the transfer belt 55 and, hence, a wider selection of transfer belts is possible for the transfer device 50.

Description will be made of a third embodiment of the present invention.

Figure 7:
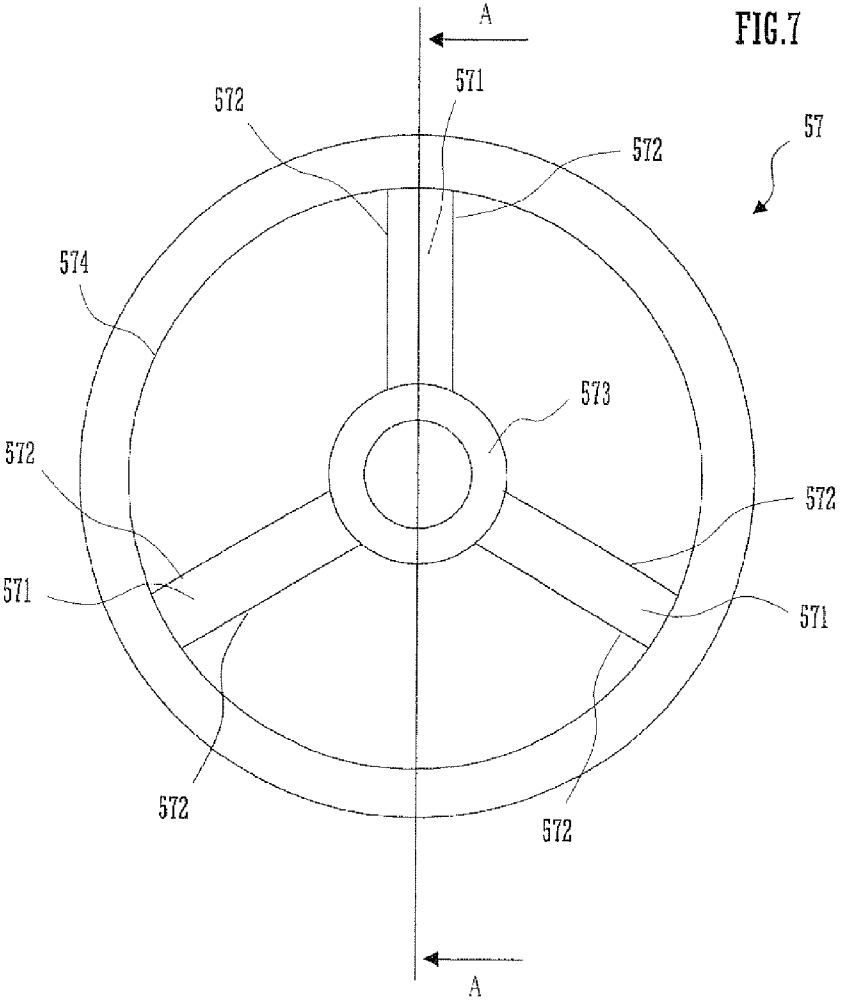
FIG. 7 is a front elevational view illustrating a transfer belt tension roller used in a transfer device according to a third embodiment of the present invention.

FIG. 7 is a front elevational view illustrating a transfer belt tension roller 57 used in a transfer device 50 according to a third embodiment of the present invention. FIG. 8 is a sectional view, taken on line A-A, of the transfer belt tension roller 57 used in the transfer device 50 according to the third embodiment.

Figure 8B:
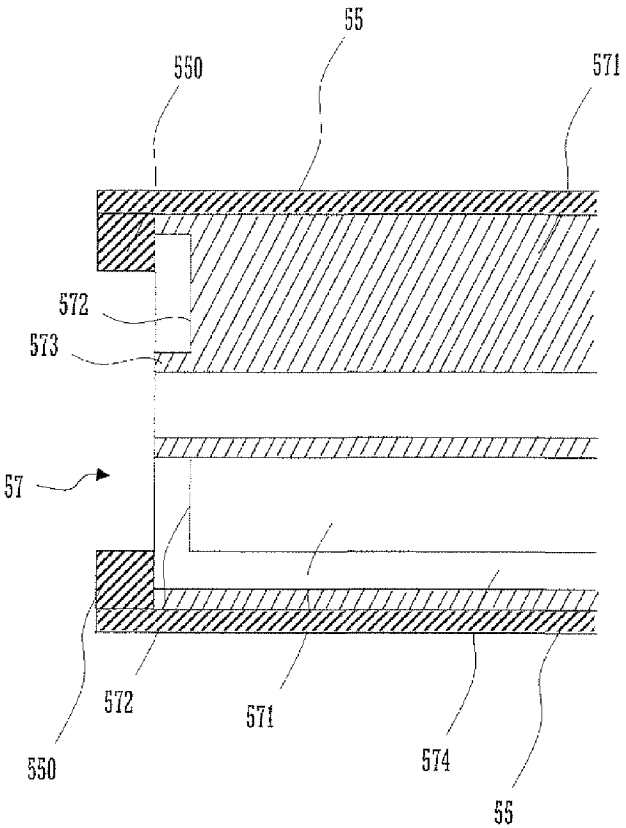
FIG. 8B is a sectional view, taken on line A-A, of the transfer belt tension roller 57 shown in FIG. 7.
Figure 8A:
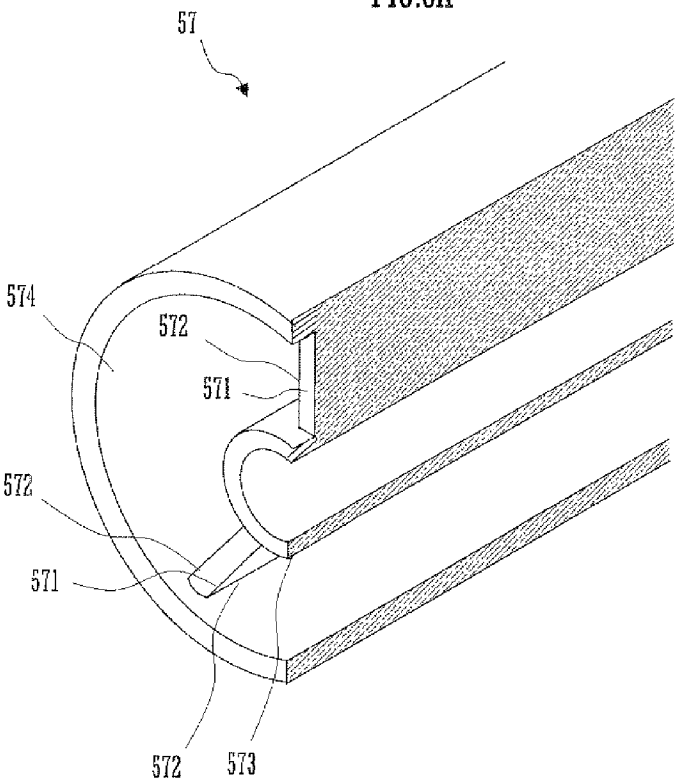
FIG. 8A is a perspective sectional view, taken on line A-A, of the transfer belt tension roller 57 shown in FIG. 7.

Specifically, FIG. 8A is a perspective sectional view, taken on line A-A, of the transfer belt tension roller 57 shown in FIG. 7; and FIG. 8B is a sectional view, taken on line A-A, of the transfer belt tension roller 57 shown in FIG. 7. In the present embodiment, the longitudinal end faces of the internal ribs 571 are located inwardly from the longitudinal end face of the transfer belt tension roller 57, while the longitudinal end face of the bearing 573 is located coplanar with the end face of the transfer belt tension roller 57.

With this feature, the bearing 573 extends up to the plane in which the longitudinal end face of the transfer belt tension roller 57 is located. For this reason, the transfer belt tension roller 57 according to the present embodiment has a larger contact area between the rotating shaft and the bearing 573 than that according to the first embodiment. Therefore, the transfer belt tension roller 57 according to the present embodiment exhibits higher stability against external force.

While the transfer belt tension roller 57 is a hollow roller in any one of the first to third embodiments, there is no limitation thereto. Preferably, the transfer belt driving roller 56 is a hollow roller having the structure according to any one of the first to third embodiments. This is because the transfer belt driving roller 56 has the function of pulling the transfer belt 55 and hence is more likely to cause the internal ribs 571 and the meandering preventive ribs 551 to come into contact with each other than any other entraining roller.

More preferably, both of the transfer belt driving roller 56 and the transfer belt tension roller 57 are hollow rollers each having the structure according to any one of the first to third embodiments. This is because the whole of the transfer device 50 can be further lightened than the arrangement having a single hollow roller and hence can be moved more easily for elimination of a sheet jam.

Most preferably, all the rollers that entrain the transfer belt 55 are hollow rollers each having the structure according to any one of the first to third embodiments. With this arrangement, the meandering preventive ribs 550 are unlikely to come into contact with the internal ribs 571 of all the entraining rollers. Therefore, this arrangement is free from the problem that the meandering preventive ribs 550 are shaved and the problem that the meandering preventive ribs 550 run on any one of the entraining rollers.

The foregoing embodiments are illustrative in all points and should not be construed to limit the present invention. The scope of the present invention is defined not by the foregoing embodiments but by the following claims. Further, the scope of the present invention is intended to include all modifications within the scopes of the claims and within the meanings and scopes of equivalents.

What is claimed is:

1. A transfer device comprising:

a transfer belt;

a plurality of rollers entraining the transfer belt thereabout; and meandering preventive ribs provided at opposite widthwise ends of an inner peripheral surface of the transfer belt for preventing the transfer belt from meandering on the plurality of rollers, wherein:

the plurality of rollers include at least one hollow roller having a central shaft and a plurality of internal ribs connecting the central shaft with, an inner periphery of the hollow roller in a radial manner;

the internal ribs are located so as not to come into contact with the meandering preventive ribs.

2. The transfer device according to claim 1, wherein the hollow roller is a driving roller for driving the transfer belt.

3. The transfer device according to claim 1, wherein the plurality of internal ribs are three internal ribs which are positioned equiangularly about the central shaft.

4. The transfer device according to claim 1, wherein the internal ribs have end faces which are inclined in such a manner as to go away from an end face of the hollow roller as the end faces extend from the inner periphery of the hollow roller toward the central shaft.

5. The transfer device according to claim 1, wherein the central shaft of the hollow roller has an end face located coplanar with an end face of the hollow roller.

6. The transfer device according to claim 1, wherein all the rollers are hollow rollers each of which is similar in structure to the hollow roller.

7. The transfer device according to claim 1, wherein the meandering preventive ribs project to a distance of 1.5 to 2.0 mm from the inner peripheral surface of the transfer belt.

8. The transfer device according to claim 1, wherein the internal ribs have end faces located inwardly by 1.0 mm from an end face of the hollow roller.

9. An image forming apparatus comprising:

an image bearing member; and the transfer device according to claim 1 for transferring a toner image horn on a surface of the image bearing member onto a sheet.

* * * * *